US006374446B1

(12) United States Patent
Gleason

(10) Patent No.: US 6,374,446 B1
(45) Date of Patent: Apr. 23, 2002

(54) PERSONAL CLEANING DEVICE

(76) Inventor: Thomas R. Gleason, 413 Exeter Pl., Marina, CA (US) 93933

( * ) Notice: Subject to any disclaimer, the term of this patent is extended or adjusted under 35 U.S.C. 154(b) by 0 days.

(21) Appl. No.: 09/512,449

(22) Filed: Feb. 25, 2000

(51) Int. Cl.[7] ..... A46B 13/02
(52) U.S. Cl. ..... 15/4; 15/23
(58) Field of Search ..... 15/4, 23, 28

(56) References Cited

U.S. PATENT DOCUMENTS

| | | | | |
|---|---|---|---|---|
| 2,166,343 A | | 7/1939 | Derks | |
| 3,307,211 A | * | 3/1967 | Gaines | 15/23 |
| 3,864,780 A | | 2/1975 | Watkins | |
| 3,932,909 A | | 1/1976 | Johnson et al. | |
| 3,965,521 A | * | 6/1976 | Wardell | 15/4 |
| D279,626 S | | 7/1985 | Mc Closkey | |
| 4,724,563 A | | 2/1988 | Fry et al. | |
| 4,817,227 A | | 4/1989 | Scott | |
| 5,636,400 A | * | 6/1997 | Young | 15/23 |
| 5,891,063 A | * | 4/1999 | Vigil | 15/23 |
| 5,974,612 A | * | 11/1999 | Cathcart | 15/23 |

* cited by examiner

*Primary Examiner*—Randall E. Chin

(57) ABSTRACT

A personal cleaning device for cleaning and deburring the hands of a user. The personal cleaning device includes a cleaning assembly. The cleaning assembly has a housing. The housing has a first end and a second end. A peripheral wall is coupled to and extends between the first and second ends. A first shaft has a first end, a second end, a distal portion and proximal portion. The distal portion is located adjacent to the second end. The first shaft is generally positioned in the housing. The first end of the first shaft is in communication with a motor in the housing. The second end of the first shaft extends out of the second end of the housing such that the distal portion is outside of the housing. A brush extends from the distal portion of the first shaft. An actuating means for actuating the motor is mounted on the housing. The actuating means is operationally coupled to the motor. A power supply is operationally coupled to the motor.

14 Claims, 4 Drawing Sheets

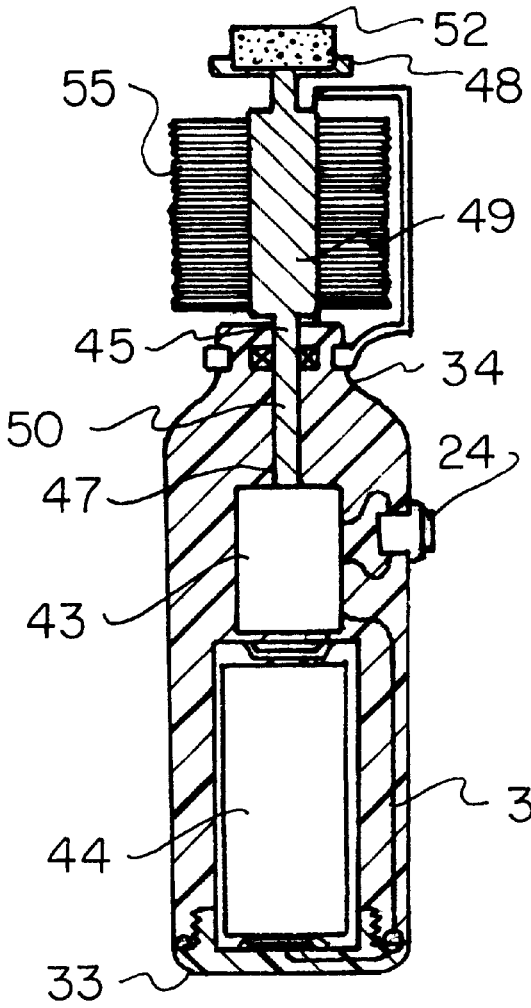
FIG. 4
FIG. 6
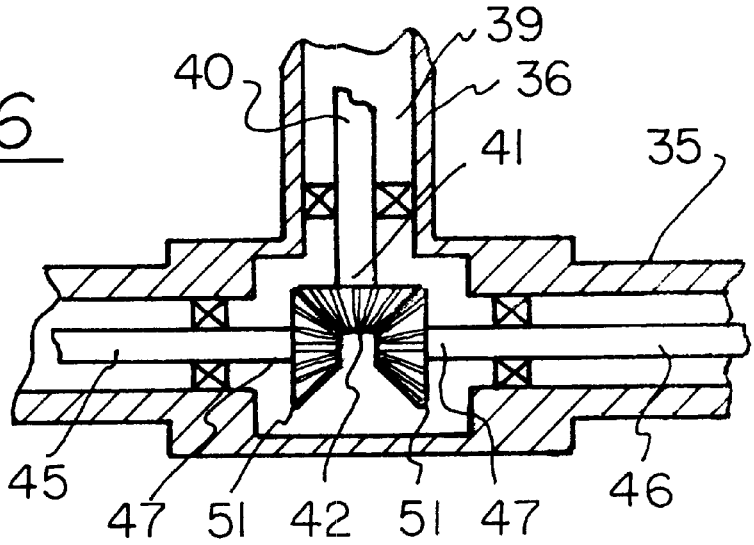

PERSONAL CLEANING DEVICE

BACKGROUND OF THE INVENTION

1. Field of the Invention

The present invention relates to cleaning devices and more particularly pertains to a new personal cleaning device for cleaning and deburring the hands of a user.

2. Description of the Prior Art

The use of cleaning devices is known in the prior art. More specifically, cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,932,909; 4,724,563; 3,864,780; 4,817,227; 2,166,343; and U.S. Des. Des. Pat. No. 279,626.

While these devices fulfill their respective, particular objectives and requirements, the aforementioned patents do not disclose a new personal cleaning device. The inventive device includes a cleaning assembly. The cleaning assembly has a housing. The housing has a first end and a second end. A peripheral wall is coupled to and extends between the first and second ends. A first shaft has a first end, a second end, a distal portion and proximal portion. The distal portion is located adjacent to the second end. The first shaft is generally positioned in the housing. The first end of the first shaft is in communication with a motor in the housing. The second end of the first shaft extends out of the second end of the housing such that the distal portion is outside of the housing. A brush extends from the distal portion of the first shaft. An actuating means for actuating the motor is mounted on the housing. The actuating means is operationally coupled to the motor. A power supply is operationally coupled to the motor.

In these respects, the personal cleaning device according to the present invention substantially departs from the conventional concepts and designs of the prior art, and in so doing provides an apparatus primarily developed for the purpose of cleaning and deburring the hands of a user.

SUMMARY OF THE INVENTION

In view of the foregoing disadvantages inherent in the known types of cleaning devices now present in the prior art, the present invention provides a new personal cleaning device construction wherein the same can be utilized for cleaning and deburring the hands of a user.

The general purpose of the present invention, which will be described subsequently in greater detail, is to provide a new personal cleaning device apparatus and method which has many of the advantages of the cleaning devices mentioned heretofore and many novel features that result in a new personal cleaning device which is not anticipated, rendered obvious, suggested, or even implied by any of the prior art cleaning devices, either alone or in any combination thereof.

To attain this, the present invention generally comprises a cleaning assembly. The cleaning assembly has a housing. The housing has a first end and a second end. A peripheral wall is coupled to and extends between the first and second ends. A first shaft has a first end, a second end, a distal portion and proximal portion. The distal portion is located adjacent to the second end. The first shaft is generally positioned in the housing. The first end of the first shaft is in communication with a motor in the housing. The second end of the first shaft extends out of the second end of the housing such that the distal portion is outside of the housing. A brush extends from the distal portion of the first shaft. An actuating means for actuating the motor is mounted on the housing. The actuating means is operationally coupled to the motor. A power supply is operationally coupled to the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal cleaning device apparatus and method which has many of the advantages of the cleaning devices mentioned heretofore and many novel features that result in a new personal cleaning device which is not anticipated, rendered obvious, suggested, or even implied by any of the prior art cleaning devices, either alone or in any combination thereof.

It is another object of the present invention to provide a new personal cleaning device which may be easily and efficiently manufactured and marketed.

It is a further object of the present invention to provide a new personal cleaning device which is of a durable and reliable construction.

An even further object of the present invention is to provide a new personal cleaning device which is susceptible of a low cost of manufacture with regard to both materials and labor, and which accordingly is then susceptible of low prices of sale to the consuming public, thereby making such personal cleaning device economically available to the buying public.

Still yet another object of the present invention is to provide a new personal cleaning device which provides in the apparatuses and methods of the prior art some of the advantages thereof, while simultaneously overcoming some of the disadvantages normally associated therewith.

Still another object of the present invention is to provide a new personal cleaning device for cleaning and deburring the hands of a user.

Yet another object of the present invention is to provide a new personal cleaning device which includes a cleaning assembly. The cleaning assembly has a housing. The housing has a first end and a second end. A peripheral wall is coupled to and extends between the first and second ends. A first shaft has a first end, a second end, a distal portion and proximal portion. The distal portion is located adjacent to the second end. The first shaft is generally positioned in the housing. The first end of the first shaft is in communication with a motor in the housing. The second end of the first shaft extends out of the second end of the housing such that the distal portion is outside of the housing. A brush extends from the distal portion of the first shaft. An actuating means for actuating the motor is mounted on the housing. The actuating means is operationally coupled to the motor. A power supply is operationally coupled to the motor.

Still yet another object of the present invention is to provide a new personal cleaning device that includes a container for dispensing liquid soap.

Even still another object of the present invention is to provide a new personal cleaning device that may be mounted on a wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic cross-sectional view of FIG. 2 of the present invention.

FIG. 6 is a schematic cross-sectional view of the arm of the present invention.

DESCRIPTION OF THE PREFERRED EMBODIMENT

Figure 1:
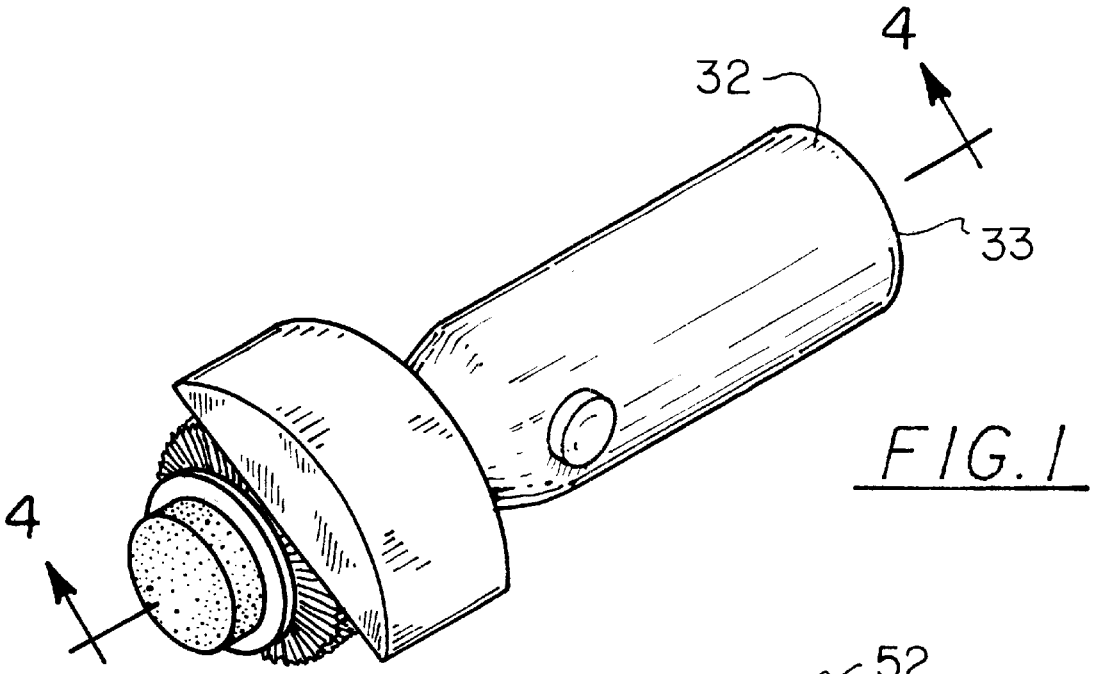
FIG. 1 is a schematic perspective view of a new personal cleaning device according to the present invention.

With reference now to the drawings, and in particular to FIGS. 1 through 6 thereof, a new personal cleaning device embodying the principles and concepts of the present invention and generally designated by the reference numeral 10 will be described.

As best illustrated in FIGS. 1 through 6, the personal cleaning device 10 generally comprises a mounting assembly 12, the mounting assembly 12 has a front wall 13, a back wall 14, a top wall 15, a bottom wall 16, a first side wall 17, and a second side wall 18. The top 15, the bottom 16, the first side 17 and the second side 18 walls extend from a back surface of the front wall 13. The back wall 14 is mountable to a wall surface.

A container 20 is mounted on the top wall 15. The container 20 has a pair of opposite sides 21. Each of the opposite sides 21 has a tube 22 fluidly connected thereto. The tubes 22 extend from the container 20 and through the back surface of the front wall 13 such that the tubes 22 extend away from the front wall 13. Each of the tubes 22 is located generally adjacent to a top edge of the front wall 13. The tubes 22 each have a free end 23 directed toward the bottom edge of the front wall 13. The container 20 is adapted to eject liquid through the tubes 22 using conventional means such as a pump. The container 20 will ideally hold liquid soap.

An actuating means 24 ejects the liquid through the tubes. The actuating means 24 is a foot pedal, which is operationally coupled to the container 22.

A cleaning assembly 30 includes a housing 32. The housing 32 has a first end 33 and a second end 34. A peripheral wall 35 is coupled to and extends between the first 33 and second 34 ends.

The first end 37 of an arm 36 is coupled to and extends away from the peripheral wall 35. The arm 36 has a second end 38 coupled to a central portion of the front wall 13 of the mounting assembly 12. The arm 36 is orientated such that the housing 32 has a longitudinal axis orientated generally perpendicular to the top edge of the front wall 13.

An aperture 39 extends through the arm 36. The aperture 39 extends through the front wall 13 and the peripheral wall 35.

A drive shaft 40 has a first end 41 and a second end, not shown. The drive shaft 40 is positioned in the aperture 39 in the arm 36. The first end 41 is generally located in the housing 32. The second end is generally located in the mounting assembly 12. The first end 41 has a gear 42 thereon. The second end is mechanically coupled to a motor 43, shown in the housing 32 in the second embodiment, in the mounting assembly. The motor is operationally coupled to the actuating means 24. The motor is operationally coupled to a power supply 44. The power supply 44 is mounted in the mounting assembly in the second embodiment depicted in FIG. 3.

Figure 2:
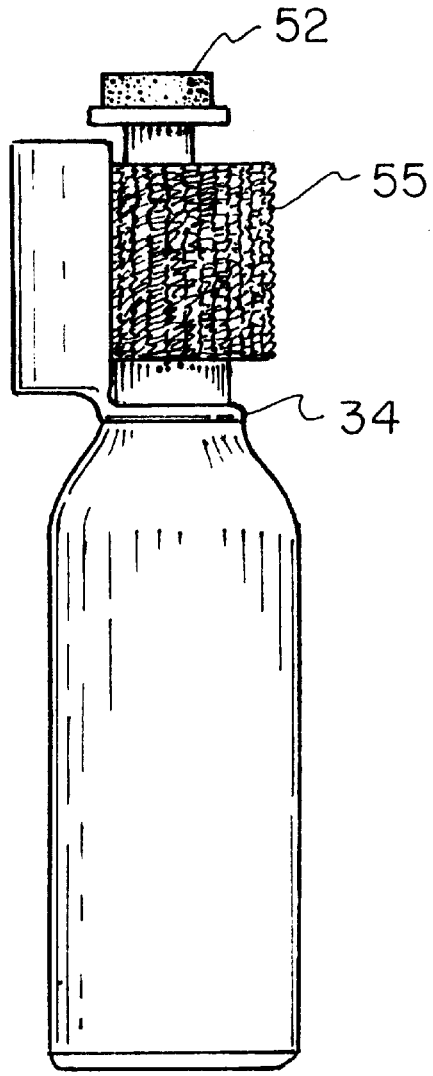
FIG. 2 is a schematic side view of the present invention.
Figure 3:
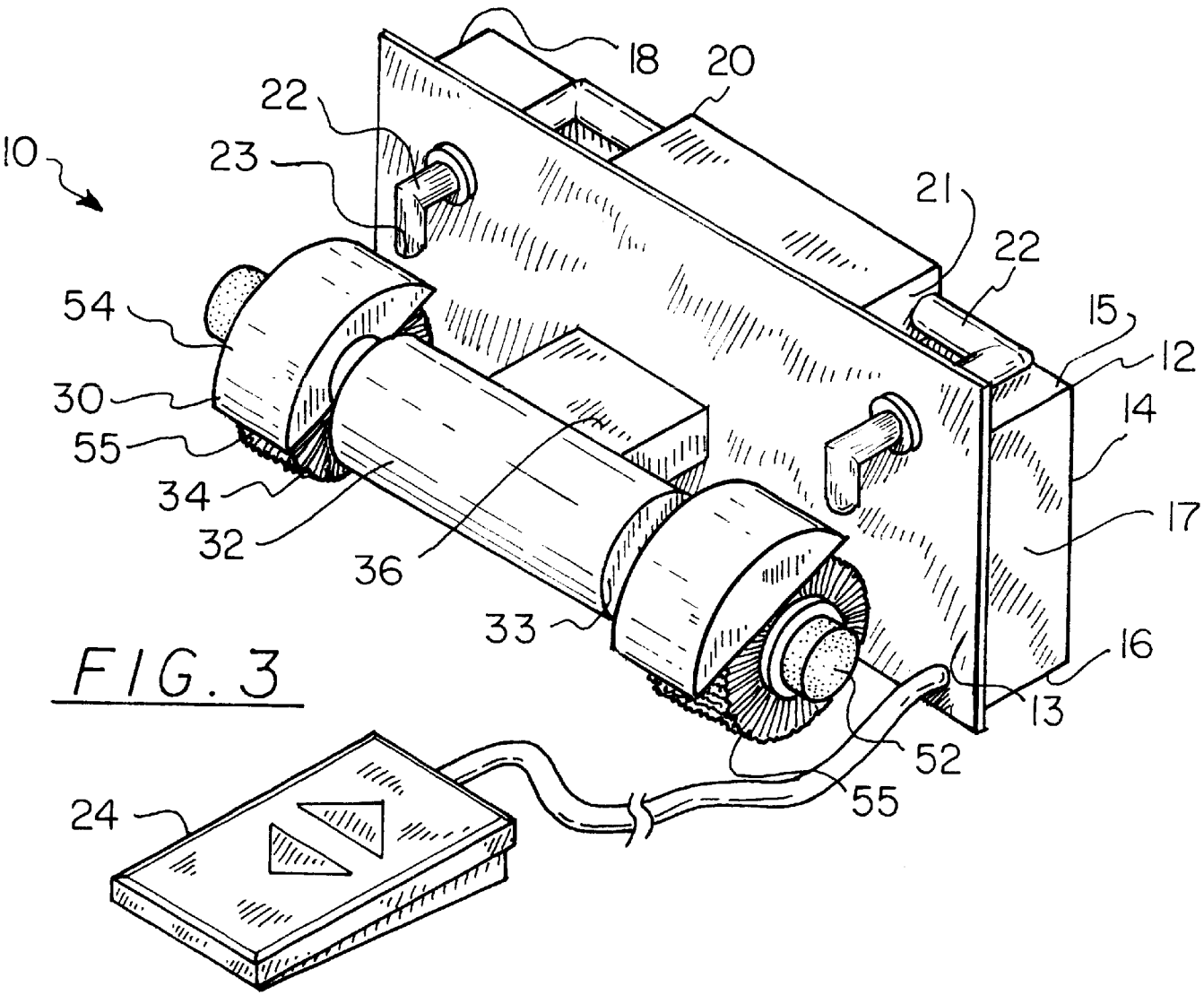
FIG. 3 is a schematic perspective view of the present invention.

A first embodiment of the invention includes a first shaft 45 having a first end 47, a second end 48, a distal portion 49 and proximal portion 50 (see generally FIGS. 1, 2, and 4). A second embodiment of the invention includes a second shaft 46 with similar features may be included (see generally FIGS. 3, 5, and 6). In each embodiment, the distal portion 49 is located adjacent to the second end 48. In the second embodiment, each of the first 45 and second shafts 46 is generally positioned in the housing 32. Each of the first ends 47 of the first 45 and second 46 shafts has a gear 51 thereon in communication with the gear 42 on the drive shaft 40. The second ends of the first 45 and second 46 shafts extend out of opposite ends 33, 34 of the housing 32 (see FIG. 3) such that the distal portions of the shafts are located outside of the housing 32.

A pair of brushes 55 each extends from one of the distal portions 49 of the first 45 and second 46 shafts. Each of the brushes 55 comprises a plurality of bristles extending away from the first and second shafts.

A pair of sanding means 52 sand the hands of a user to deburr the skin. Each of the sanding means 52 is fixedly coupled to one of the second ends 48 of the first 45 and second 46 shafts. Each of the sanding means 52 is preferably a pumice stone.

A pair of shielding means 54 shields the user from the brushes 55. Each of the shields 54 is fixedly mounted to the housing 32 and each extends over a portion of the brushes 55. The shielding means 54 may comprise a cover adapted to cover an upper portion of the brushes 55.

Figure 5:
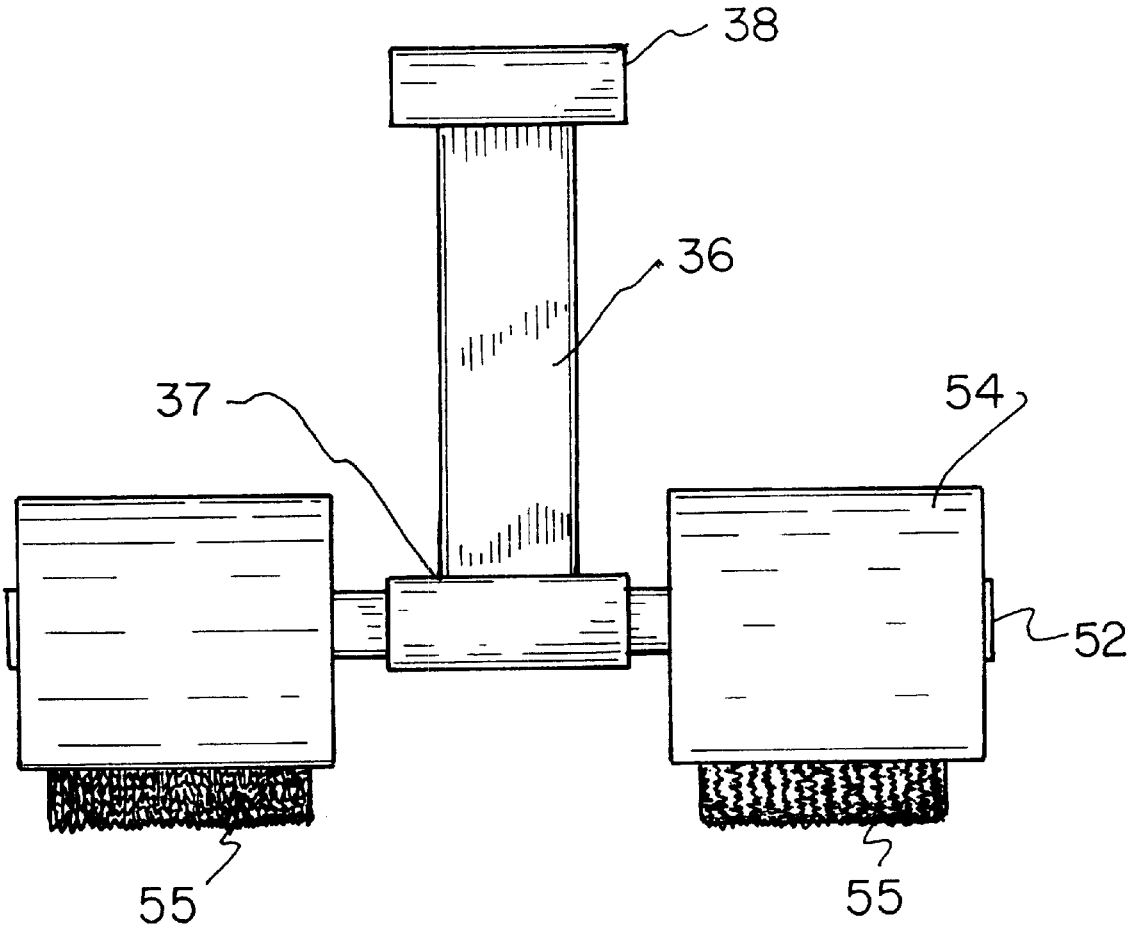
FIG. 5 is a schematic plan view of the arm of the present invention.

The first embodiment of the invention has a stand alone housing 32 which has the motor 44 and actuating means 24 therein. The second embodiment is better suited for doctors and others who need both hands scoured without touching any instrumentation. The [second] first embodiment is designed for regular use by people wishing for cleaner hands at work or home. FIG. 5 shows a slight variation in the second embodiment in which a longer arm 36 for positioning the cleaning assembly away from the mounting assembly. Ideally, the actuating means 24 in the second embodiment is adapted to control the release of liquid from the container 20 and the speed of the motor 44. The actuating means may be any conventional actuating means.

In use, the user simply uses the actuating means 24 to actuate the motor to start the rotation of the brushes 55 and pumice stone 52. The pumice stone will help remove particularly difficult items from the skin of the user. If needed, the actuating means 24 may be used to pump liquid cleanser from the container 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal cleaning device comprising:

a cleaning assembly comprising:

a housing having a first end and a second end, a peripheral wall being coupled to and extending between said first and second ends;

a first shaft having a first end, a second end, a distal portion and proximal portion, said distal portion being located adjacent to said second end, said first shaft being generally positioned in said housing, said first end of said first shaft being in communication with a motor in said housing, said second end of said first shaft extending out of said second end of said housing such that said distal portion is outside of said housing;

a brush extending from said distal portion of said first shaft;

an actuating means for actuating said motor, said actuating means being mounted on said housing, said actuating means being operationally coupled to said motor;

a power supply being operationally coupled to said motor;

a sanding means for sanding the hands of a user, said sanding means being mounted on said shaft for rotating said sanding means.

2. The personal cleaning device as in claim 1, wherein said sanding means comprises a pumice stone.

3. The personal cleaning device as in claim 1, further comprising a shielding means for shielding the user from said brush.

4. The personal cleaning device as in claim 3, wherein said shielding means comprises a shield plate mounted on said housing and extending over a portion of said brush.

5. The personal cleaning device as in claim 4, wherein said shield plate is curved substantially about a line of curvature coaxial with an axis of rotation of said brush.

6. The personal cleaning device as in claim 5, wherein said shielding means includes a pair of end walls extending from said shield plate toward said brush.

7. A personal cleaning device comprising:

a cleaning assembly comprising:

a housing;

a shaft having a first end and a second end, said shaft having a first portion thereof proximate to said first end being positioned in said housing, a second portion of said shaft extending exterior of said housing;

a motor located in said housing and being operatively coupled to said first end of said shaft for rotating said shaft;

a brush mounted on said second portion of said shaft;

a sanding means for sanding the hands of a user, said sanding means being mounted on said shaft for rotating said sanding means with said brush.

8. The personal cleaning device as in claim 7, wherein said sanding means comprises a pumice stone.

9. The personal cleaning device as in claim 7, additionally comprising an actuating means for actuating said motor, said actuating means being mounted on said housing and being operatively coupled to said motor.

10. The personal cleaning device as in claim 7, additionally comprising a power supply being located in said housing and being operationally coupled to said motor.

11. The personal cleaning device as in claim 7, further comprising a shielding means for shielding the user from said brush.

12. The personal cleaning device as in claim 11, wherein said shielding means comprises a shield plate mounted on said housing and extending over a portion of said brush.

13. The personal cleaning device as in claim 12, wherein said shield plate is curved substantially about a line of curvature coaxial with an axis of rotation of said brush.

14. The personal cleaning device as in claim 13, wherein said shielding means includes a pair of end walls extending from said shield plate toward said brush.

* * * * *